United States Patent [19]

Teng

[11] Patent Number: 4,960,217

[45] Date of Patent: Oct. 2, 1990

[54] BALLOON-TYPE BOTTLE SEALER

[76] Inventor: Hsieh-Yih Teng, P.O. Box 10160, Taipei, Taiwan, 30002

[21] Appl. No.: 409,348

[22] Filed: Sep. 19, 1989

[51] Int. Cl.[5] ..... B65D 39/12

[52] U.S. Cl. ..... 215/271; 215/100 R

[58] Field of Search ..... 215/271, 269, 100

[56] References Cited

U.S. PATENT DOCUMENTS

| | | | |
|---|---|---|---|
| 387,466 | 8/1888 | Watson | 215/100 R |
| 2,034,739 | 3/1936 | Bodor | 215/271 X |
| 2,040,798 | 5/1936 | Schoonmaker | 215/271 |
| 3,402,844 | 9/1968 | Chin | 215/100 R X |

FOREIGN PATENT DOCUMENTS

| | | | |
|---|---|---|---|
| 1138982 | 2/1957 | France | 215/271 |

*Primary Examiner*—Donald F. Norton

[57] ABSTRACT

A bottle sealer includes a telescopic expansible hollow extension of a balloon shape formed on a disk portion of the sealer sealed in a bottleneck, and in fluid communication with a liquid filled in a bottle so that when the bottle filled with a liquid or water is subjected to a freezing temperature to become ice, the balloon extension may serve as a buffer for absorbing the volume expansion due to a conversion of water into ice.

1 Claim, 1 Drawing Sheet

BALLOON-TYPE BOTTLE SEALER

BACKGROUND OF THE INVENTION

This application is a divisional application of U.S. patent application etitled "Bottle Sealer Serving as a Temperature Buffer", filed on 11/09/1988 having a serial number of 07/269,876, now patent No. 4,901,875.

U.S. Pat. No. 4,771,902 issued to the same applicant of this application discloses a container having a bottleneck inversely mounted on a base packed by a bell-shape sealer made of elastomer materials, of which the sealer includes plural annular extension rings concentrically circumferentially formed on an inside wall of the sealer, adapted to be turned up along the bottleneck to pack the bottle-neck tightly in a base when inversely mounting the container on the supporting base.

However, such a container, when filled with water and subjected to a temperature below zero degree centigrade, may be broken since the inside water is frozen to expand its volume to cause breakage of a glass container, especially when transported in a very cold weather.

The present inventor has found the defects of the original invention and invented the present sealer having a buffer effect especially for a cold temperature.

SUMMARY OF THE INVENTION

The object of the present invention is to provide a bottle sealer having a telescopic expansible hollow extension generally made as a balloon shape in fluid communication with the bottle so that when the bottle filled with water is subjected to an environment temperature below zero degree centigrade to freeze the inside water to become ice, the volume expansion due to the conversion of water to ice may expand the telescopic extension without expansibly breaking a glass bottle.

DETAILED DESCRIPTION

Figure 1:
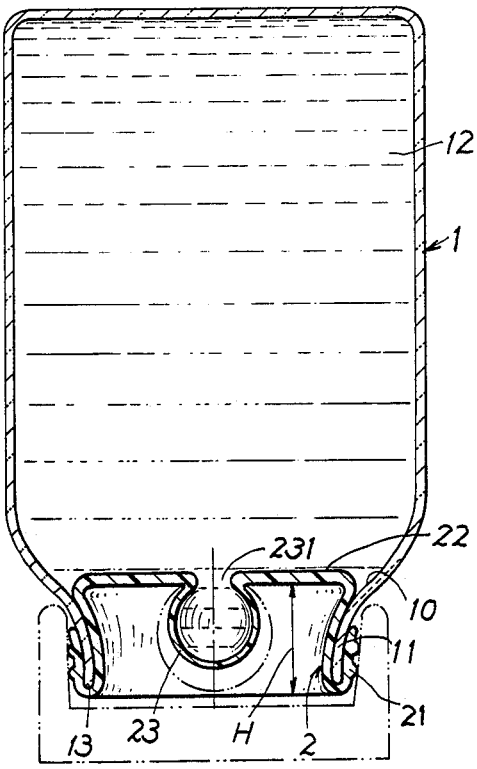
FIG. 1 is a sectional elevation of the present invention.

As shown in FIG. 1, the present invention comprises: a sealer 2 sealing in a bottleneck 11 of a bottle 1 which may be a container for filling liquid 12 therein or may be a transparent crystal ball for decorative purpose. The sealer 2 may be made of elastomer materials such as rubber or silicon rubber. For decorative purpose, a decorative article such as a doll, a figure, or an animal may be mounted on the sealer 2 inside the bottle 1.

The sealer 2 includes: a cylindrical skirt portion 21 protruding outwardly from an inner disk portion 22 to be turned up along an outer edge 13 of the bottleneck 11, the inner disk portion 22 sealably inserted in a taper portion 10 of the bottle 1 within the bottleneck 11, and a telescopic expansible hollow extension 23 which is formed as a balloon shape as shown in FIG. 1, concave outwardly from the inner disk portion 22 to form a balloon, having an opening 231 in fluid communication with the liquid 12 in the bottle 1. A height H between a bottom surface of the disk portion 22 and the outer edge 13 of the bottleneck 11 should be larger than an expansion height of the balloon extension 23 as shown in dotted line of FIG. 1.

When handling the water-filled glass bottle 1 of this invention in a freezing weather such as below zero degree centigrade, the water 12 may be frozen to become ice to expand its volume inside the bottle, causing an expansion of the balloon extension 23 without breaking the bottle 1.

Since the sealer 2 is made of elastomers such as rubber which is a thermal insulator, the sealer 2 when subjected to a freezing weather may delay the freezing rate of its nearby water than the remaining water inside the glass bottle 1 so as to prevent an earlier ice formation and clogging in the opening 231 of the balloon extension 23.

When a conventional crystal ball filled with decorative article and water in the ball is sealed with the present sealer 2, it will not be broken even handled in a freezing weather since the volume expansion due to the conversion of water into ice may be absorbed in the telescopic hollow balloon extension 23 as aforementioned.

For display purpose, a base or holder (not shown) may be further provided for inserting the bottleneck into a socket of the base or holder for a stable arrangement.

Figure 2:
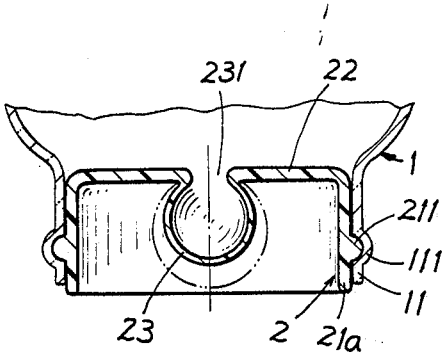
FIG. 2 shows another form of a skirt portion of a sealer of the present invention as derived from FIG. 1.

As shown in FIG. 2, the cylindrical skirt portion 21*a* of the sealer 2 may be formed with an annular extension 211 for engaging an annular groove 111 formed in the bottle neck 11 so that the sealer 2 may be snugly mounted in the bottle neck 11 of the bottle 1.

Figure 3:
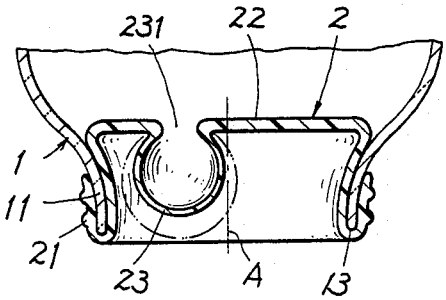
FIG. 3 shows another form of the sealer of the present invention.
Figure 4:
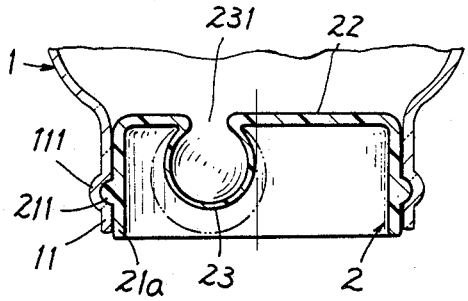
FIG. 4 shows a modified sealer skirt of the present invention as derived from FIG. 3.

As shown in FIGS. 3 and 4, the balloon 23 may not be formed at a central portion of the sealer 2 and may be positioned apart from a longitudinal axis A of the bottle 1.

The materials for making the sealer 2 of the present invention is not limited. However, a flexible elastomeric material is preferable.

I claim:

1. A bottle sealer made of elastomer materials sealably inserted in a bottleneck of a bottle comprising an inner round disk portion sealably inserted in the bottleneck, and a balloon extension formed in said inner round disk portion concave outwardly from said disk portion having an opening formed in said balloon extension in fluid communication with a liquid filled in the bottle, a height defined between a bottom surface of the disk portion and an outer edge of the bottleneck being larger than an expansion height of the balloon extension when the bottle and the balloon extension filled with the liquid are subjected to a volume expansion due to cold temperature, said bottleneck being inserted into a socket of a base or holder for a stable display purpose of the bottle.

* * * * *